United States Patent [19]

Buna et al.

[11] Patent Number: 4,799,541

[45] Date of Patent: Jan. 24, 1989

[54] CONICAL CONTACT HEAT EXCHANGER

[75] Inventors: Tibor Buna, Evergreen; William H. Miller, Littleton, both of Colo.

[73] Assignee: Martin Marietta Corporation, Bethesda, Md.

[21] Appl. No.: 83,364

[22] Filed: Aug. 10, 1987

[51] Int. Cl.[4] ..... F28D 15/02; F28F 5/00

[52] U.S. Cl. ..... 165/78; 165/80.5; 165/81; 165/104.14; 29/157.3 R

[58] Field of Search ..... 165/80.1–80.5, 165/78, 104.14, 81; 29/157.3 R

[56] References Cited

U.S. PATENT DOCUMENTS 2,146,541 2/1939 Hansell ..... 165/80.4

4,537,247 8/1985 Okamoto et al. ..... 165/78

FOREIGN PATENT DOCUMENTS 182057 10/1983 Japan ..... 165/104.14

*Primary Examiner*—Albert W. Davis, Jr.

*Attorney, Agent, or Firm*—Seymour Levine; Martin G. Anderson

[57] ABSTRACT

A two member heat exchanger. The first member having an outer surface, a conical inner surface surrounding a hollow region, a fluid chamber between the outer surface and the conical inner surface, and first and second fluid ports diametrically positioned on the outer surface to permit the flow of fluid in and out of the fluid chamber. The second member, insertable into the hollow region of the first member, has an outer conical surface matching the inner conical surface of the first member and a cylindrical bore for receiving external heat dissipating devices.

11 Claims, 1 Drawing Sheet

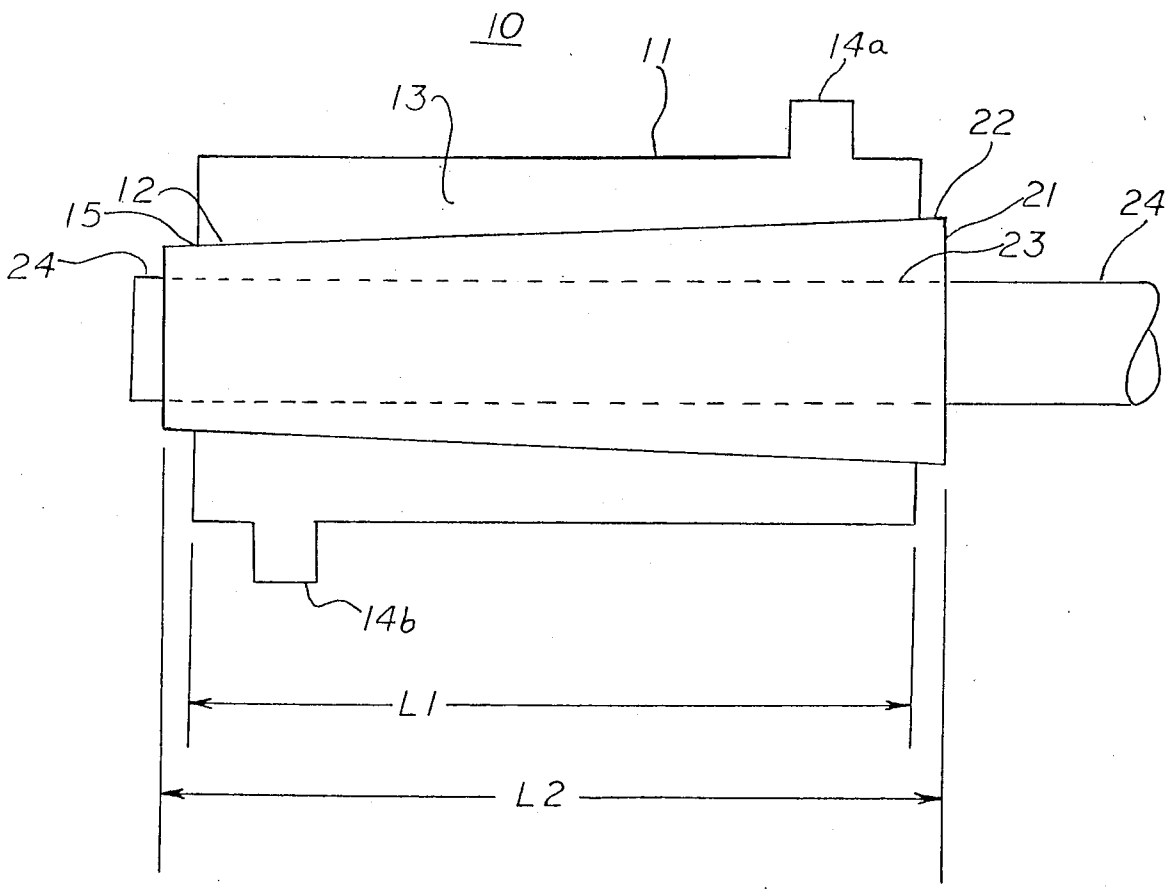
10
11
12
13
14a
14b
15
21
22
23
24
24
L1
L2

CONICAL CONTACT HEAT EXCHANGER

BACKGROUND OF THE INVENTION

Many heat dissipating systems utilize a heat pipe attached to a radiator wherefrom heat is radiated into the environment. Fluid contained in the heat pipe is vaporized at the hot end, wherefrom it is transposted to the cooler end by the pressure differential between the two ends. At the cooler end the heat pipe is attached to the radiator whereat the vapor is condensed and caused to flow back to the hot end by capillary means disposed within the container. Deterioration of the radiator with time severely limits the efficiency of the system and replacement is required since the radiator is permanently attached to the heat pipe for maximum heat transfer, it is not a replaceable unit. Consequently, for space applications the entire heat pipe-radiator assembly must be replaced on orbit. Incorporation of heat exchanger surfaces, in unbonded contact, in the heat transport path from the fluid loop to the radiator is a necessary condition for disconnect capability of plug-in replaceability of the heat pipe/radiator assembly.

One replaceable heat pipe-radiator assembly in the prior art has the hot end of the heat pipe embedded in a rectangular heat conducting block which transfers heat by contact conductance to a flat plate of dimensions greater than the block. The block extends from one side and is bolted to another flat plate wherein pipes of cooling fluid are embedded which extend into the heated area to be cooled. This device, though providing a replaceable heat pipe-radiator assembly, does not provide the heat exchange efficiency between the two flat plates that is required in many applications. Additionally, this arrangement has the added complication of bolt removement and replacement when an exchange is to be made. A more efficient variant of this system bolts flat plates containing cooling fluid pipes to two surfaces of the rectangle. Though this provides more efficient heat transfer, the undesirable complication of bolt removal and replacement for an exchange of assemblies remains.

A heat exchange that exhibits improve heat transfer over the flat plate configuration utilizes a cylindrical sleeve positioned over the hot end of the heat exchanger. The inner surface of the sleeve, that surface facing the heat pipe, has an inflatable bladder containing the coolant fluid. In this device, the bladder is expanded to maintain thermal contact with the heat pipe by pressurizing a gas containing chamber in the bladder. Although the device provides more efficient heat transfer to the heat pipe than does the flat plate devices, it is bulky, requires a gas supply, and becomes inoperative should a puncture occur in the bladder. Yet another device is described in U.S. Pat. No. 4,324,375 entitled "Heat Sink Fluid-to-Fluid Mechanical Coupling of Spacecraft Coolant Systems". The disadvantages of U.S. Pat. No. 4,324,375 are the same as those previously mentioned for the bladder.

An object of this invention is to provide contact heat exchanger surfaces and supporting infra structures to meet or exceed the stringent requirements of space station type applications.

SUMMARY OF THE INVENTION

A heat exchanger in accordance with the principles of the present invention receives waste heat via a coolant containing tube coupled to an annular heat exchanger having two principal members. The first member of the heat exchanger has a hollow inner section with a conically shaped surface, while the second member, for insertion in the hollow section of the first member, has an outer conical surface matching that of the inner surface of the first member. Heat is exchanged from one member to the other through these conically shaped surfaces by conduction due to a positive thermal contact between the two members. The second member is bonded or soldered to the evaporation section of a heat pipe, which in turn transfers the heat to a radiator for radiation into the environment.

BRIEF DESCRIPTION OF THE DRAWING

The sole FIGURE is a schematic representation of the invention.

DESCRIPTION OF THE PREFERRED EMBODIMENT

Referring to the figure, there can be seen a heat exchanger 10 having a first member 11 having an annular outer surface, a conical inner surface 12 surrounding a hollow region, and a chamber 13 through which coolant fluid flows via diametrically positioned fluid line connectors **14*a* and 14*b*. Though only two fluid line connectors are shown, this is not a limitation. Any number of fluid connectors may be employed to meet fluid flow requirements. A second member 21, designed for insertion into the hollow region of the first member, has a conical outer surface 22 matching the inner conical surface 12 of the first member 11, and an inner cylindrical surface 23 surrounding a hollow region wherein a heat pipe 24** may be inserted and attached by bonding or soldering.

The conical inner contact surface 12 of the outer member 11 and the outer surface 22 of the inner member 21 are precision machined to a cone angle, which for example, may be 20 minutes of arc half angle, +5 arc seconds tolerance on the slope. These conical contact surfaces 12, 21 should have an optical quality finish with variations over the surface that are less than 14 micro inches per inch RMS and should typically be 6 micro inches per inch RMS>

The inner contact surface 12 of the outer member 11 and the outer surface 22 of the inner member 21, which are contacting surfaces, may be lubricated with an appropriate space qualified lubricant, such as grease, to prevent locking, galling, or cold welding of the surfaces. This grease also promotes contact heat conductance and facilitates insertion and removal of the second member 21 into the hollow region of the first member 11. A suitable grease for this application is manufactured by the Bray Oil Company of California and is marketed under the trademark BRAYCOTE 601. Prior to the application of the grease lubricant, the surfaces 12 and 21 should be cleaned with a suitable detergent. In a vacuum environment the presence of contaminates on the conical surfaces may cause the formation of voids in the grease layer due to surface tensions flaws, thereby impairing thermal performance.

A constant pressure is applied to maintain the inner surface 12 of the first member 11 and the outer surface 22 of the second member 21 in good thermal contact. The grease layer thickness may decrease as a function of time causing the second member 21 to move axially into the first member 11 and may affect the contacting area between the two surfaces. The contacting area between the two surfaces may also be affected by the diameter tolerances of the two surfaces. These variations in contacting area may be eliminated by providing a length L1 fo the first member that is shorter than the length L2 of the second member.

A force may be applied between the first member 11 and the second member 21 by springs, not shown, which combined with the length differential and the conically shaped surfaces provides a self-adjusting capability to the heat exchanger that compensates for the grease flow and the affects of differential thermal expansion/contraction between the members to maintain a constant contact area. A force F required to maintain a given contact pressure P between the two conical surfaces may be given by $P=6.5\times F$. A force required to maintain an equal pressure P between the flat plate surfaces of the prior art would be given approximately by $F=170\times P$. Additionally, thermal vacuum test results indicate that the heat transfer between surfaces in the present invention is an order of magnitude greater than that of the prior art. It is therefore evident that a more efficient heat exchanger with an appreciably lower force requirement to maintain contact pressure between the exchanging surfaces is provided by the present invention.

While the inventioon has been described in its preferred embodiment, it is to be understood that the words which have been used are words of description rather than limitation and that changes may be made within the purview of the appended claims without departing from the true scope and spirit of the invention in its broader aspects.

We claim:

1. A heat exchanger comprising:

a first member of predetermined length having an outer surface and a conical inner surface, with a predetermined cone angle, surrounding a hollow region extending for said predetermined length to provide first and second open ends; and a second member of preselected length greater than said predetermined length having an outer conical surface with a cone angle equal to said predetermined cone angle, removably inserted in said hollow region such that said outer surface of said second member is in thermal contact with said inner surface of said first member and extends beyond said first and second ends, said preselected length and said predetermined length providing a length differential which, in cooperation with said predetermined cone angle, provides a self adjustment to relative movements of said first and second members caused by thermal expansions and contractions, whereby thermal contact between said first and second members is maintained over said predetermined length.

2. A heat exchanger in accordance with claim 1 wherein said first member has a hollow fluid chamber between said outer surface and said conical inner surface and further includes means connected to said outer surface in a fluid exchanging relationship with said chamber for coupling to external fluid lines whereby fluid flowing through said external fluid lines circulates through said fluid chamber and said external fluid lines.

3. The heat exchanger of claim 2 wherein said second member has a cylindrical inner bore and further includes an external heat conducting device inserted in said inner bore and fixedly attached to said second member.

4. The heat exchanger of claim 3 wherein a lubricant is applied between said inner and outer conical surfaces.

5. A heat exchanger in accordance with claim 3 wherein said conical inner surface and said conical outer surface have half cone angles of 20 minutes of arc.

6. A heat exchanger in accordance with claim 5 wherein at least one of said inner and outer surfaces has a lubricant applied thereto.

7. A heat exchanger in accordance with claim 2 wherein said coupling means comprises a first fluid port positioned on said outer surface and a second fluid port positioned on said outer surface in diametric relationship with said first fluid port.

8. A method for establishing a heat exchanger comprising the steps of:

providing a first member of predetermined length having a conically shaped inner surface of predetermined cone angle surrounding a hollow region extending for said predetermined length to provide first and second open ends;

providing a second member of preselected length greater than said predetermined length having a conically shaped outer surface with a cone angle equal to said predetermined cone angle;

cleansing said inner conical surface and said outer conical surface to remove foreign matter;

applying a grease to at least one of said inner and outer surfaces; and inserting said second member into said hollow region of said first member such that said inner conical surface and said outer conical surface are in thermal contact and said second member extends beyond said first and second open ends.

9. The method of claim 8 further including the step of finishing said inner conical surface and said outer conical surface to an optical quality finish prior to said cleansing step.

10. The method of claim 8 further including the steps of:

providing a fluid chamber in said first member; and providing external fluid line couplings in a fluid exchanging relationship with said fluid chamber.

11. The method of claim 10 further including the steps of:

providing said second member with a cylindrical inner bore;

inserting an external heat exchanging device in said bore; and attaching said external heat exchanging device to said second member.

* * * * *